US010603601B2

(12) United States Patent
Wang

(10) Patent No.: US 10,603,601 B2
(45) Date of Patent: Mar. 31, 2020

(54) PARTY POPPER

(71) Applicant: Yu-Jen Wang, Taichung (TW)

(72) Inventor: Yu-Jen Wang, Taichung (TW)

( * ) Notice: Subject to any disclaimer, the term of this patent is extended or adjusted under 35 U.S.C. 154(b) by 0 days.

(21) Appl. No.: 16/424,502

(22) Filed: May 29, 2019

(65) Prior Publication Data

US 2019/0374869 A1 Dec. 12, 2019

(30) Foreign Application Priority Data

Jun. 7, 2018 (CN) ..... 2018 20 881530

(51) Int. Cl.
*A63H 37/00* (2006.01)

(52) U.S. Cl.
CPC ..... *A63H 37/005* (2013.01)

(58) Field of Classification Search
CPC ..... A63H 37/00; A63H 37/005; A63H 13/16; A63H 5/04; F41A 1/00; F41B 11/66
USPC ..... 446/14, 399, 406, 475, 483, 486
See application file for complete search history.

(56) References Cited

U.S. PATENT DOCUMENTS 1,567,973 A * 12/1925 Mendelson ..... A63H 13/16 446/198
1,664,401 A * 4/1928 Craig ..... A63H 37/00 446/475
3,951,037 A * 4/1976 Bornand ..... F41F 1/06 89/1.3
5,338,242 A * 8/1994 Cheng ..... A63H 37/00 446/183
6,572,435 B1 * 6/2003 Wong ..... A63H 37/00 124/16
8,876,574 B2 * 11/2014 Bourdelaise ..... A63H 37/00 446/399
9,636,603 B2 * 5/2017 Wang ..... A63H 37/00
2006/0199469 A1 * 9/2006 Du ..... A63H 37/00 446/475
2018/0164083 A1 * 6/2018 Okamura ..... F42B 4/04

* cited by examiner

*Primary Examiner* — Nini F Legesse

(57) ABSTRACT

A party popper contains: a body which includes two first openings defined on two ends of the body respectively. A flexible push portion is mounted on an end of the body, and a launchable cylinder is slidably accommodated in the body. The body includes a surrounding rib fitted thereon, and the flexible push portion is configured to drive the launchable cylinder to slide until the launchable cylinder is stopped by the surrounding rib. Multiple launchable objects are launched from the launchable cylinder inertially, thus launching the multiple launchable objects safely.

14 Claims, 5 Drawing Sheets

PARTY POPPER

FIELD OF THE INVENTION

The present invention relates to a launch device of a popper, and more particularly to a party popper.

BACKGROUND OF THE INVENTION

A conventional popper is applied for celebration in happy hours. The conventional popper contains a launch device driven in an air pressurizing manner or a fire lighting manner. However, a transmission structure of the conventional popper has multiple iron sheets, thus causing danger when the multiple iron sheets are launched out of the conventional popper. In addition, it is dangerous after launching the conventional popper by lighting the fire.

The present invention has arisen to mitigate and/or obviate the afore-described disadvantages.

SUMMARY OF THE INVENTION

The primary objective of the present invention is to provide a party popper which launches the multiple launchable objects safely.

A party popper provided by the present invention contains: a body, a launchable cylinder, and a flexible push portion.

The body includes two first openings defined on two ends thereof respectively, the launchable cylinder is slidably accommodated in the body, the launchable cylinder includes the multiple launchable objects received therein, the flexible push portion is mounted on a first end of the body and is configured to drive the launchable cylinder to slide along the body, and a surrounding rib is arranged in a sliding path of the launchable cylinder so as to stop the launchable cylinder, and the multiple launchable objects are launched from the launchable cylinder inertially.

Thereby, the flexible push portion drives the launchable cylinder to launch the multiple launchable objects safely.

DETAILED DESCRIPTION OF THE PREFERRED EMBODIMENTS

Figure 1:
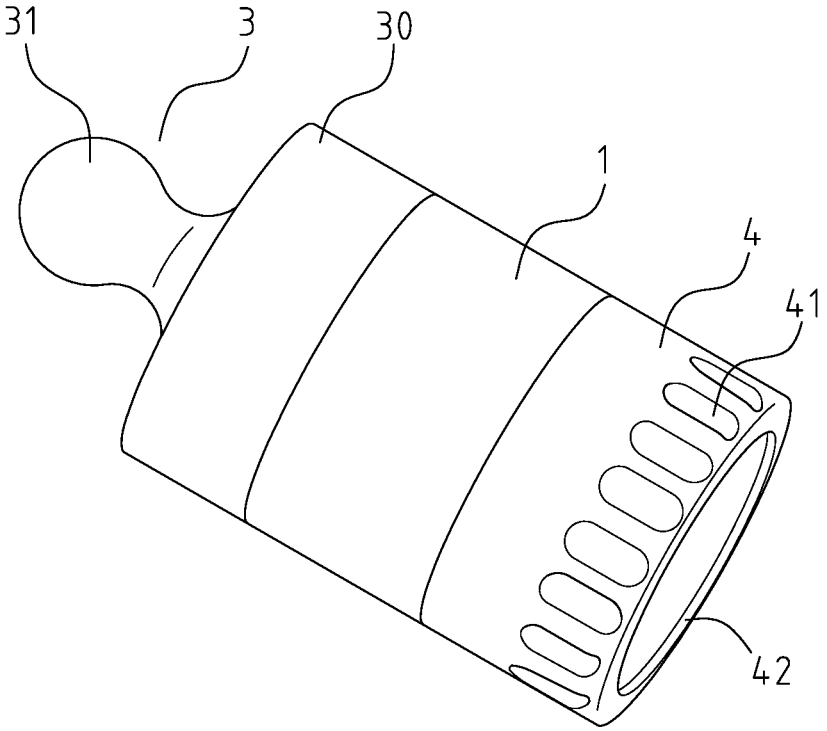
FIG. 1 is a perspective view showing the assembly of a party popper according to a preferred embodiment of the present invention.

With reference to FIGS. 1-5, a party popper according to a preferred embodiment of the present invention comprises:

a body 1, a launchable cylinder 2, and a flexible push portion 3, wherein the body 1 includes two first openings 13 defined on two ends thereof respectively, the launchable cylinder 2 is slidably accommodated in the body 1, a surrounding rib 42 is arranged in a sliding path of the launchable cylinder 2, the flexible push portion 3 is mounted on a first end of the body 1 and is configured to drive the launchable cylinder 2 to slide along the body 1, and a connection sleeve 4 is fitted on a second end of the body 1, wherein the surrounding rib 42 is arranged on the connection sleeve 4.

The launchable cylinder 2 includes multiple second openings 21 formed on an end thereof away from the flexible push portion 3, the multiple launchable objects 22 received in the launchable cylinder 2, and multiple stop sheets 23 defined among the multiple launchable objects 22 and the multiple second openings 21 respectively, wherein when the multiple launchable objects 22 are not launched, the multiple stop sheets 23 stop the multiple launchable objects 22 being launched from the launchable cylinder 2, the multiple stop sheets 23 are made of foam or other lightweight materials. The launchable cylinder 2 further includes multiple receiving parts 20 arranged therearound, and the multiple receiving parts 20 have the multiple second openings 21, the multiple launchable objects 22, and the multiple stop sheets 23 individually, wherein the multiple receiving parts 20 accommodate the multiple launchable objects 22 in different colors based on using requirements so as to launch the multiple launchable objects 22 vividly. Each of the multiple receiving parts 20 has a third opening 24 formed on an end of each receiving part 20 so that air flows into each receiving part 20 from the third opening 24 to avoid air tightness in each receiving part 20 and to launch the multiple launchable objects 22 from each receiving part 20 smoothly.

The flexible push portion 3 is made of any one of rubber, silicone, and flexible material. The flexible push portion 3 includes a flexible sleeve 30 fitted on the body 1, an urge plate 32 adjacent to the launchable cylinder 2, a deformable protrusion 31 extending from an end surface of the flexible sleeve 30 back to the urge plate 32, wherein the deformable protrusion 31 is in a pacifier shape.

Figure 6:
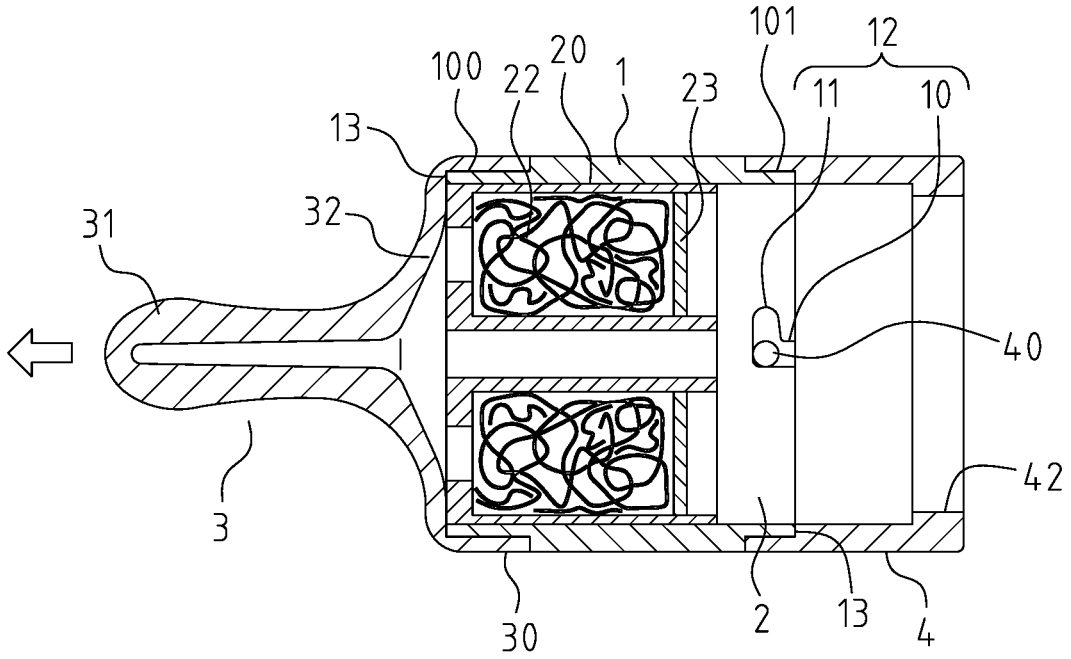
FIG. 6 is a cross sectional view showing the operation of the party popper according to the preferred embodiment of the present invention.
Figure 7:
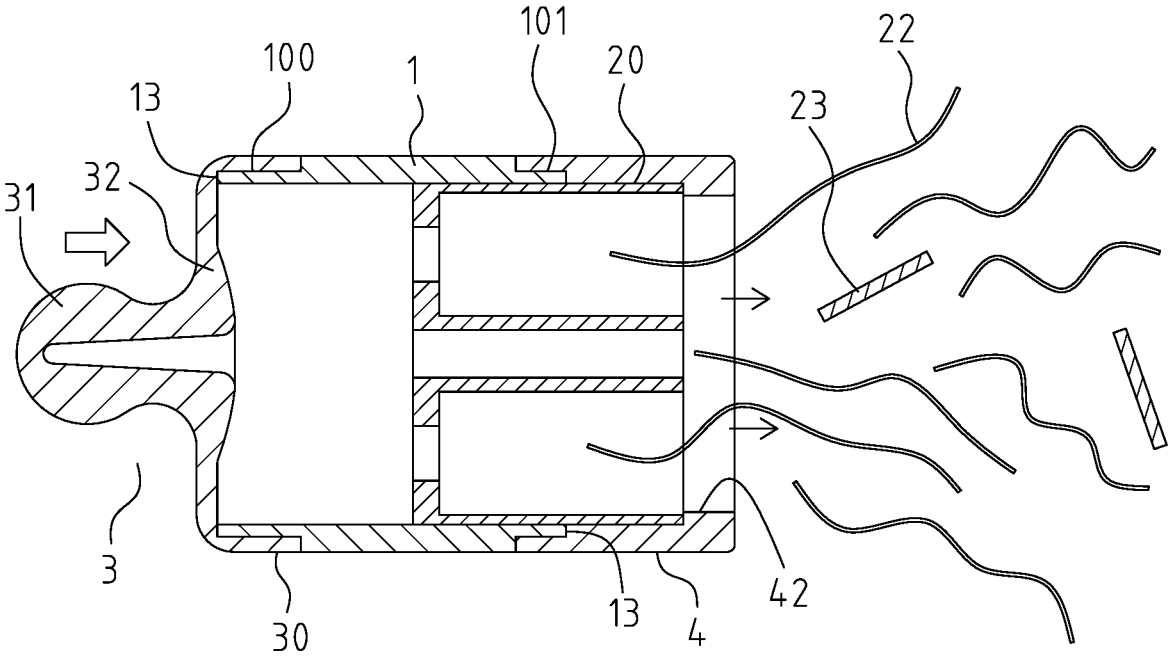
FIG. 7 is another cross sectional view showing the operation of the party popper according to the preferred embodiment of the present invention.

Referring to FIGS. 6 and 7, as desiring to launch the multiple launchable objects 22 of the launchable cylinder 2, the launchable cylinder 2 contacts with the urge plate 32, the deformable protrusion 31 is manually pulled away from the launchable cylinder 2 to urge the urge plate 32 to deform away from the launchable cylinder 2 in a cone shape (as shown in FIG. 6). Then, the deformable protrusion 31 is released to bounce toward the launchable cylinder 2 with the urge plate 32 (as illustrated in FIG. 7), the urge plate 32 pushes the launchable cylinder 2 to slide toward the connection sleeve 4. When the launchable cylinder 2 contacts with the surrounding rib 42, the launchable cylinder 2 is stopped by the surrounding rib 42 and the multiple launchable objects 22, and the multiple stop sheets 23 of the launchable cylinder 2 move toward the connection sleeve 4, thereafter the multiple stop sheets 23 remove the launchable cylinder 2, the multiple launchable objects 22 move away from the launchable cylinder 2 and launch from the connection sleeve 4. Thereby, the multiple launchable objects 22 are launched from the launchable cylinder 2 safely by ways of the flexible push portion 3.

Figure 3:
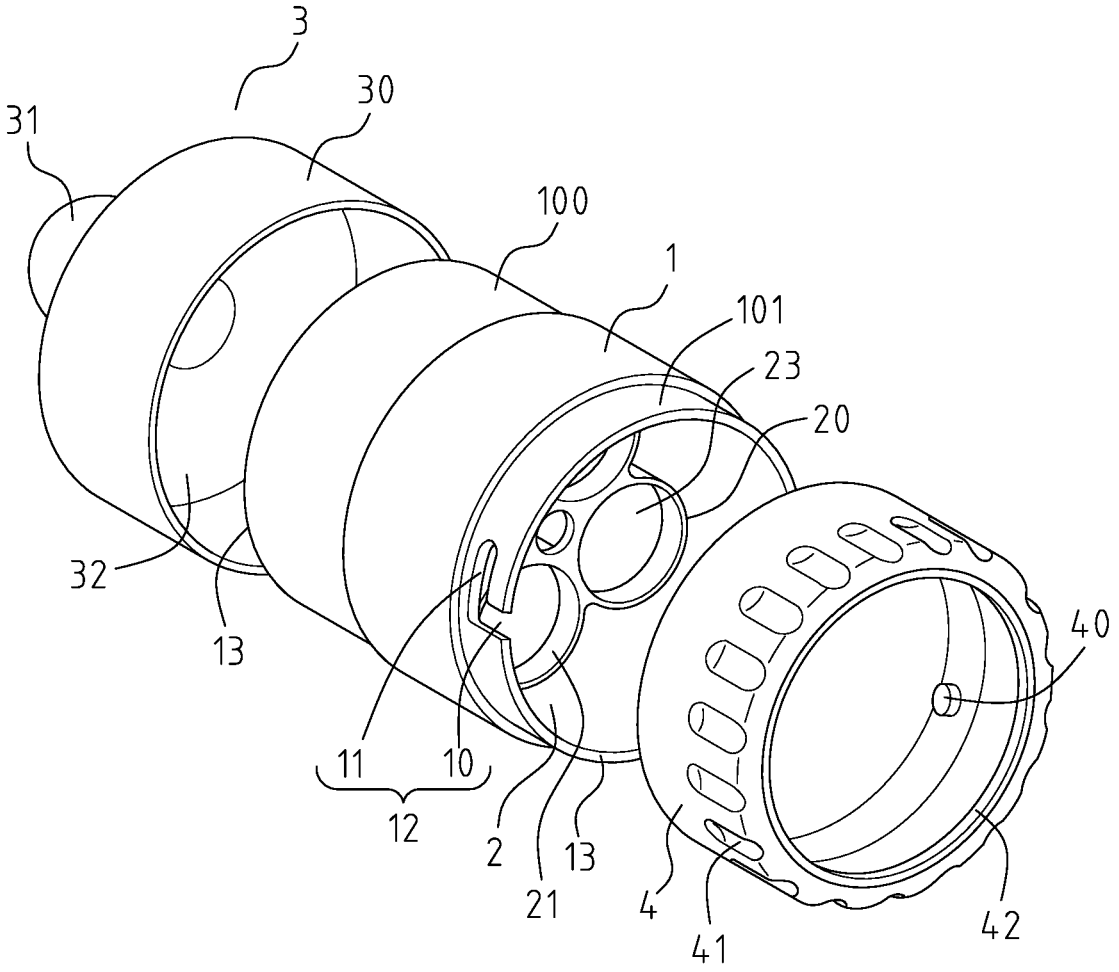
FIG. 3 is a perspective view showing the exploded components of the party popper according to the preferred embodiment of the present invention.
Figure 4:
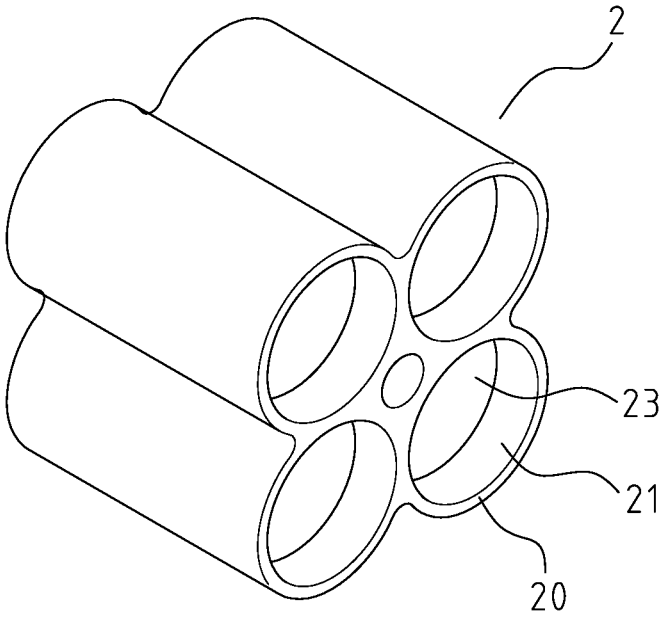
FIG. 4 is a perspective view showing the assembly of a launchable cylinder of the party popper according to the preferred embodiment of the present invention.
Figure 5:
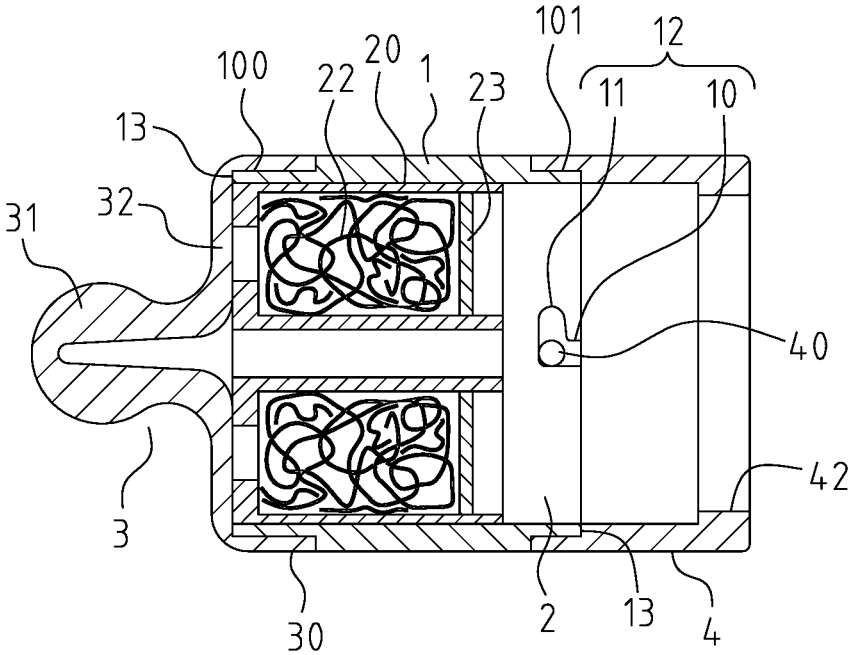
FIG. 5 is a cross sectional view showing the assembly of the party popper according to the preferred embodiment of the present invention.

The connection sleeve 4 is rotatably fitted on the body 1. As shown in FIGS. 3 and 5, the connection sleeve 4 includes two locking columns 40 extending from an inner wall thereof, the body 1 includes two grooves 12 corresponding to the two locking columns 40, wherein each of the two grooves 12 has a first part 10 and a second part 11, the first part 10 extends inward to the body 1 from an end of each groove 12 adjacent to the connection sleeve 4, and the second part 11 extends along a peripheral wall of the body 1 and communicates with the first part 10. When connecting the connection sleeve 4, each of the two locking columns 40 is aligned with the first part 10, the connection sleeve 4 is rotated so that each locking column 40 slides along the first part 10. When each locking column 40 slides toward the second part 11, the connection sleeve 4 is rotated continuously so that each locking column 40 is slid to a distal end of the second part 11.

A number of the two locking columns 40 is increased or decreased based on using requirements, and a number of the two grooves 12 is increased or decreased to match with the number of the two locking columns 40. Changing the numbers of the two locking columns 40 and the two grooves 12 is a well-known art and a design option in related technical field.

Figure 2:
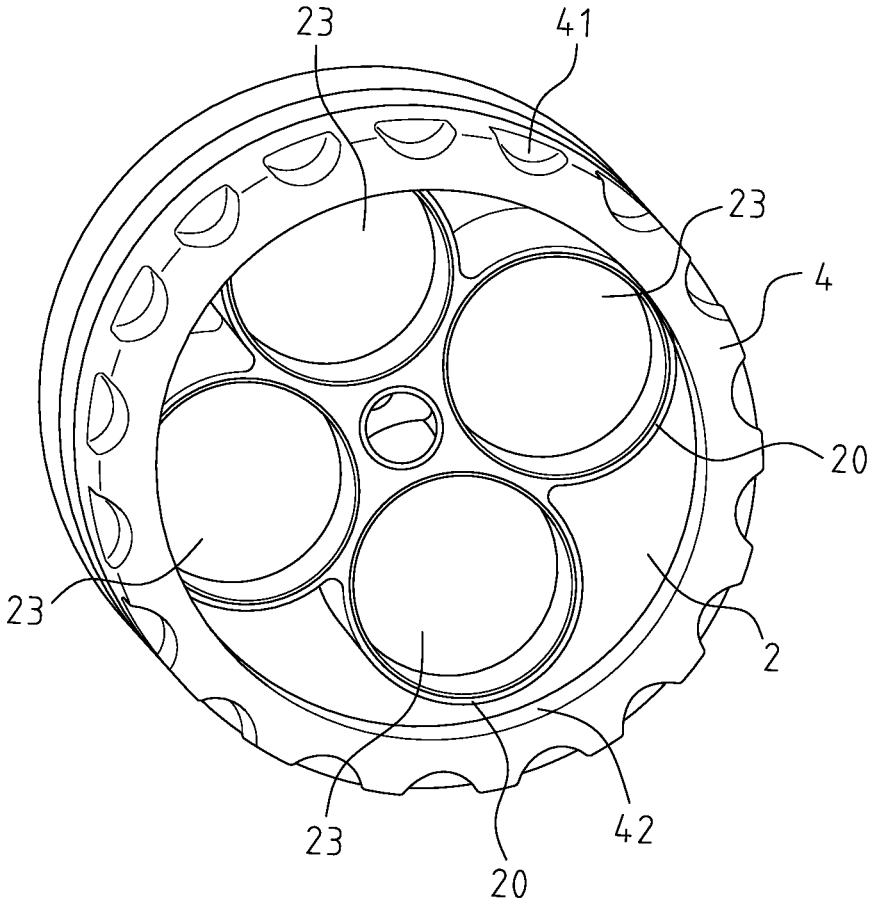
FIG. 2 is another perspective view showing the assembly of the party popper according to the preferred embodiment of the present invention.

With reference to FIGS. 1-3, the connection sleeve 4 further includes multiple recesses 41 defined around an outer wall thereof so as to enhance friction of the outer wall of the connection sleeve 4, thus rotating the connection sleeve 4 easily.

Referring to FIGS. 3 and 5, the surrounding rib 42 protrudes from an inner wall of the connection sleeve 4, wherein an inner diameter of the surrounding rib 42 is less than an inner diameter of the body 1, and the inner diameter of the surrounding rib 42 is less than an outer diameter of the launchable cylinder 2, such that the surrounding rib 42 stops the launchable cylinder 2. As desiring to replace the launchable cylinder 2, the connection sleeve 4 is rotated to remove from the body 1 so as to replace the launchable cylinder 2.

The surrounding rib 42 is replaced to the body 1 based on the using requirements. Alternatively, the connection sleeve 4 includes at least one projection (not shown) arranged on the inner wall thereof.

As shown in FIGS. 3 and 5, the body 1 includes a first shoulder 100 formed on the first end thereof and fitted with the flexible push portion 3, and the body 1 includes a second shoulder 101 formed on the second end thereof and fitted with the connection sleeve 4. The flexible sleeve 30 is fitted with the first shoulder 100, the connection sleeve 4 is fitted with the second shoulder 101, the two grooves 12 are formed on the second shoulder 101, the connection sleeve 4 further includes an engagement ring 400 fitted on the second shoulder 101, and the two locking columns 40 are arranged on the engagement ring 400.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A party popper comprising: a body, a launchable cylinder, and a flexible push portion;

wherein the body includes two first openings defined on two ends thereof respectively, the launchable cylinder is slidably accommodated in the body, the launchable cylinder includes the multiple launchable objects received therein, the flexible push portion is mounted on a first end of the body and is configured to drive the launchable cylinder to slide along the body, and a surrounding rib is arranged in a sliding path of the launchable cylinder so as to stop the launchable cylinder, and wherein the flexible push portion is made of flexible material, and the flexible push portion includes a flexible sleeve fitted on the body, the flexible sleeve has an urge plate adjacent to the launchable cylinder, the flexible sleeve has a deformable protrusion extending from an end surface thereof back to the urge plate so as to pull the urge plate to deform and to push the multiple launchable objects to slide.

2. The party popper as claimed in claim 1, wherein the flexible push portion is made of rubber or silicone.

3. The party popper as claimed in claim 1, wherein the deformable protrusion is in a pacifier shape.

4. The party popper as claimed in claim 1, wherein the body includes a connection sleeve fitted on a second end thereof opposite to the flexible push portion, and the surrounding rib is arranged on the connection sleeve.

5. The party popper as claimed in claim 4, wherein the surrounding rib protrudes from an inner wall of the connection sleeve, and an inner diameter of the surrounding rib is less than an outer diameter of the launchable cylinder, such that the surrounding rib stops the launchable cylinder sliding outward.

6. The party popper as claimed in claim 4, wherein the connection sleeve includes at least one locking column extending from an inner wall thereof, the body includes at least one groove corresponding to the at least one locking column, wherein each of the at least one groove has a first part and a second part, the first part extends inward to the body from an end of each groove adjacent to the connection sleeve, and the second part extends along a peripheral wall of the body and communicates with the first part so that the at least one locking column slide to a distal end of the second part along the first part.

7. The party popper as claimed in claim 4, wherein the connection sleeve further includes multiple recesses defined around an outer wall thereof so as to rotate the connection sleeve easily.

8. The party popper as claimed in claim 4, wherein the body includes a second shoulder formed on the second end thereof and fitted with the connection sleeve, the two grooves are formed on the second shoulder.

9. The party popper as claimed in claim 8, wherein the connection sleeve further includes an engagement ring fitted on the second shoulder, and the at least one locking column is arranged on the engagement ring.

10. The party popper as claimed in claim 1, wherein the body includes a first shoulder formed on the first end thereof and fitted with the flexible push portion, and the flexible sleeve is fitted with the first shoulder.

11. The party popper as claimed in claim 1, wherein the launchable cylinder includes multiple second openings formed on an end thereof away from the flexible push portion, multiple stop sheets are defined among the multiple launchable objects and the multiple second openings respectively, and the multiple stop sheets are made of lightweight materials.

12. The party popper as claimed in claim 11, wherein the launchable cylinder further includes multiple receiving parts arranged therearound, and the multiple receiving parts have the multiple second openings, the multiple launchable objects, and the multiple stop sheets individually.

13. The party popper as claimed in claim 12, wherein each of the multiple receiving parts has a third opening formed on an end of each receiving part so that air flows into each receiving part from the third opening.

14. The party popper as claimed in claim 12, wherein the multiple receiving parts accommodate the multiple launchable objects in different colors.

* * * * *